United States Patent [19]

Sierk

[11] Patent Number: 4,459,908

[45] Date of Patent: Jul. 17, 1984

[54] CAN COMPACTOR

[76] Inventor: Anthony H. Sierk, 904 Palm Trail, Delray Beach, Fla. 33444

[21] Appl. No.: 533,804

[22] Filed: Sep. 19, 1983

[51] Int. Cl.[3] ..... B30B 9/32

[52] U.S. Cl. ..... 100/218; 100/266; 100/293; 100/902

[58] Field of Search ..... 100/902, 218, 266, 245, 100/293, 98 R

[56] References Cited

U.S. PATENT DOCUMENTS 3,934,498 1/1976 Hochanadel ..... 100/266 X
4,168,661 9/1979 Wigdahl ..... 100/218
4,326,457 4/1982 Sather ..... 100/218
4,345,518 8/1982 Cash et al. ..... 100/98 R

*Primary Examiner*—Billy J. Wilhite
*Attorney, Agent, or Firm*—Victor F. Volk

[57] ABSTRACT

A compactor for salvaging aluminum cans has a removable upright tube that fits into a groove in the base; a replaceable anvil has an arcuate slot that fits over a section of the above-mentioned groove, and the tube wall passes through this slot to reach the groove. A thrust rod, bearing a crushing block, is hingedly connected to a lever arm by means of a U-bolt so that it can remain substantially upright.

6 Claims, 3 Drawing Figures

CAN COMPACTOR

BACKGROUND OF THE INVENTION

It is in the public interest to salvage aluminum cans, and this may be done most efficiently if the cans are compacted to reduce their bulk for shipping and storing. To keep a compacting apparatus clean it is an advantage if the tube within which the cans are compacted can be lifted out for cleaning, and it is a further advantage, energy-wise, if the work of compacting can all be done by hand, as is the case with my invention. It is a further advantage that, if a plurality of cans are compacted before they are removed, they can be removed quickly by merely lifting the tube from its base.

In a hand operated machine a high mechanical advantage for the lever arm is important to avoid fatigue and this is made possible in my apparatus by the U-bolt connection which permits me to bring the compacting tube closer to the fulcrum, as shall be hereinafter explained.

SUMMARY OF THE INVENTION

I have invented an improved can compactor comprising a base with walls that define a substantially horizontal groove in the base into which is removably fitted an upwardly extending tube means. Opposite side wall portions of the tube means define lever-arm-accepting slots, and other wall portions of the tube means define a can-receiving opening. A bottom wall portion of the tube means defines a can ejection slot, opening on the bottom edge of the tube means and adds an additional wall portion defining an opening opposite the slot so that a rod or other instrument can be inserted to push compacted cans out through the slot. A fulcrum means is supported on a post that is fixedly connected to the base, and a lever arm is pivotally supported by the fulcrum means. This lever arm passes through the slots in the tube means and can be moved up and down within them. A thrust member or piston is pivotally attached to the lever arm so that it can move within the tube means. In our preferred embodiment the lever arm supports a structural loop, such as a U-bolt and the thrust member is slidably and hingedly engaged by the loop so that it can retain a substantially vertical or upright position within the tube means when the lever arm is moved. The immediate compacting element is a crushing block attached to the lower extremity of the thrust member to compact cans when the lever arm is lowered.

DETAILED DESCRIPTION OF A PREFERRED EMBODIMENT

Figures 1, 2, 3:
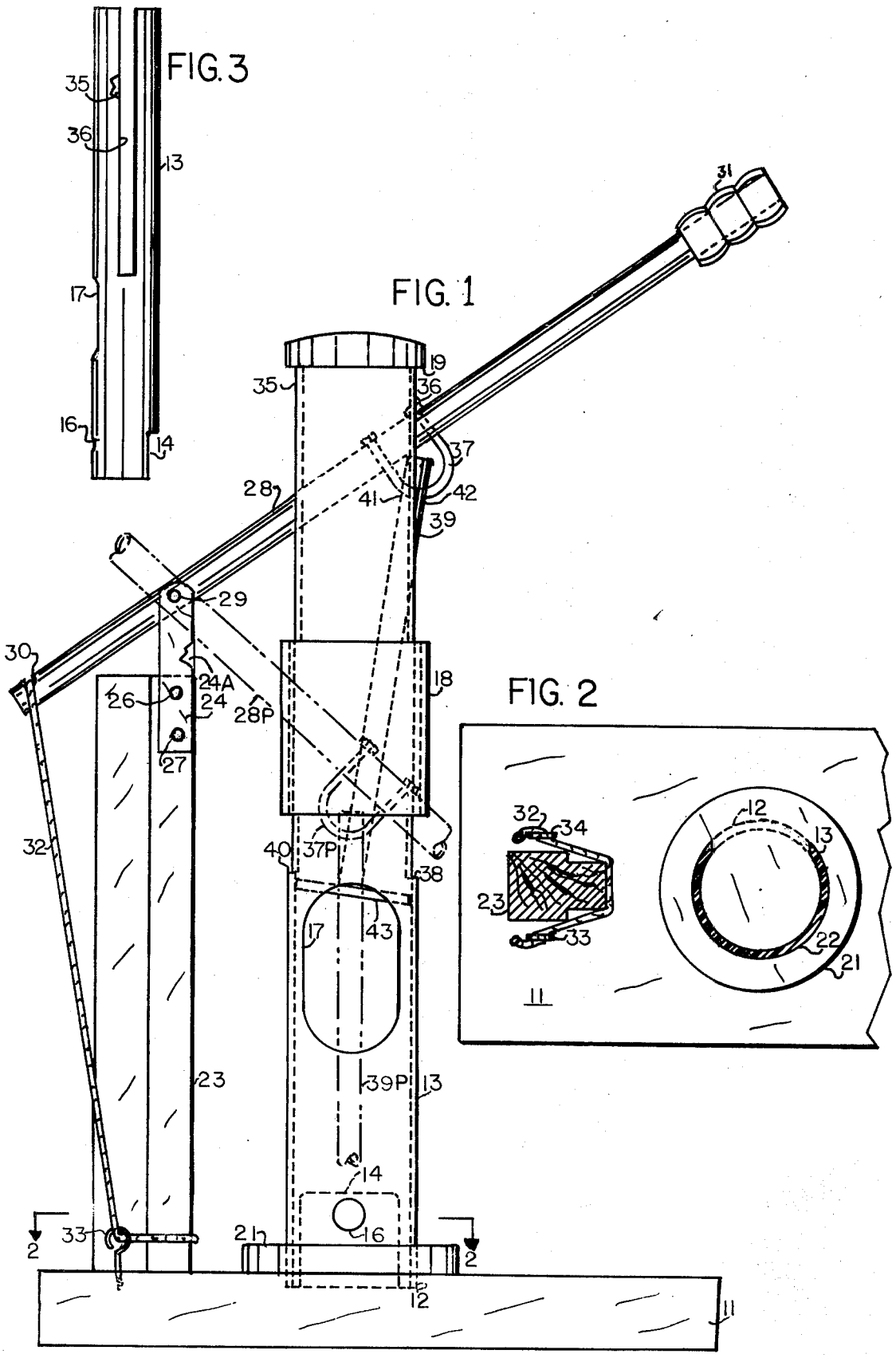
FIG. 1 shows a pictorial view of my compactor.
FIG. 2 shows a top view through the plane 2—2 of FIG. 1.
FIG. 3 shows an elevation of the tube 13 of my compactor.

Referring to FIG. 1 a base 11, which I prefer to be made of wood, but which may also be composition or metal within the scope of my invention, has a horizontal groove 12, see, also FIG. 2, fitting the lower edge of a cylindrical tube 13 which is relieved to form a slot 14 (see also FIG. 3). Opposing the slot 14 and facing the viewer in FIG. 1 there is an opening 16 through the wall of the tube 13 through which a rod or other instrument can be used to force compacted cans out through the slot 14. A larger opening 17 in the tube 13 is used to introduce uncompacted cans into the apparatus. A sleeve 18 fits the tube 13 tightly enough to stay in any position to which it is pushed on the tube. The sleeve 18 may be slid down to cover the opening 17 during the compacting operation. This feature is particularly useful when a plurality of cans are compacted without taking any out, a more efficient method of operating when a large number of cans are required to be compacted. Under these circumstances also, instead of ejecting cans one at a time through the slot 14, it may be more efficient to lift the tube 13 out of the groove 12 to release all the compacted cans at one time. Cans are about 2 9/16 in. in diameter (6.51 cm) and the tube 13 is wide enough that compacted cans do not jam it.

A close fitting cap 19 not only strengthens the tube 13 but provides comfortable support for one hand of an operator when he is using the other to press the lever arm to be described. A replaceable anvil 21, in the shape of a flat disc having a diameter substantially greater than that of the tube 13 has an arcuate passageway 22 matching a portion of the groove 12 corresponding to the uncut portion of the tube bottom. Thus in the illustrated embodiment the bottom of the tube 13 is not a full circle because of the slot 14. Accordingly the uncut bottom edge of the tube 13 passes through the passageway 22 to seat in the groove 12. A fulcrum post 23 firmly attached to the base 11 by conventional means, not shown, supports two cooperating fulcrum members 24, 24A bolted to the post 23 by bolts 26, 27. A lever arm 28 is pivotally mounted between the fulcrum members 24, 24A by means of a pin 29. The front end of the arm 28 is covered by a hand-grip 31 and the rear end is notched at 30 to receive an endless tensile cord 32 looped under hooks 33, 34 that are screwed into the base 11 at either side of the post 23. The cord 32 provides tensile spring means to raise the lever arm automatically after a compacting stroke. The lever arm 28 passes through two deep slots 35, 36 with respective bottoms 38, 40 in the tube 13, and, in fact, helps to steady the tube in conjunction with the groove 12. A U-bolt 37 through the lever arm 28 pivotally and slidingly engages a thrust member 39 by passing through two loosely fitting holes 41, 42 therein. The member 39 terminates in a crushing block 43 which compacts cans against the anvil 21 upon depression of the lever arm handle 31. I have found a diameter of 3 inches (7.62 cm) to be suitable for the block 43 with a tube 13 that provides an easy fit.

The U-bolt 37 constitutes a structural loop which permits the thrust member 39 to remain substantially upright within the tube 13 at different positions of the lever arm 28 which is shown in FIG. 1 with the block 43 at the top of the opening 17. The position of the U-bolt 37 and thrust member 39 when the block 43 is all the way down is shown in phantom by 28P, 37P, and 39P. By means of this looped linkage I have been able to reduce the distance between the post 23 and tube 13 and thus obtain a greater mechanical advantage, so that a child can easily compact a 16 oz. aluminum can with my apparatus.

It will be understood that other spring means than the cord 32 such, for example as a coiled tensile spring can be used to return my lever arm 28, but cords of the type of the cord 32 are readily available in bicycle shops where they are sold for holding packages in bicycle racks. My tube 13 is conveniently constructed of PVC standard piping and the sleeve 18 may also be advantageously made of synthetic polymeric material. The base 11 comprises a block of wood and the replaceable anvil 21 is also wood, these materials being lighter in weight and more attractive aesthetically than steel. It will be understood, however, that the use of other materials of construction for the elements of my apparatus will fall within the scope of my invention.

In the use of my compactor a can is inserted, upright, through the opening 17, the lever arm being raised due to the action of the spring 32. When the lever-arm handle 31 is lowered the can is compacted against the anvil 21 or against earlier compacted cans. The compacted can does not necessarily have to be removed before compacting another can, but the operation may continue and when the cans reach the bottom of the opening 17 the sleeve 18 can be slid over the opening before the lever arm is lowered. To remove one or a few cans an instrument is inserted through the opening 16, forcing them out through the slot 14. Alternatively, or for a larger number of cans the tube 13 can be lifted out of the groove 12 and passageway 22 and tipped so that the compacted cans drop out.

I have invented a new and useful can compacting apparatus the foregoing description of which is exemplary rather than definitive and for which I desire an award of Letters Patent as defined in the following claims.

I claim:

1. A can compactor comprising,

A. a base comprising walls defining a substantially horizontal groove in said base, B. an upwardly extending tube means, a. the bottom of said tube means removably fitting into and being restrained from lateral movement by said groove, b. opposite side wall portions of said tube means defining lever-arm-accepting slots, c. wall portions of said tube means defining a can-receiving opening, d. bottom wall portions of said tube means defining a can-ejection aperture, C. an upwardly extending fulcrum post fixedly supported on said base, D. fulcrum means, said fulcrum means being supported on said post, E. a lever arm, a. said lever arm being pivotally supported by said fulcrum means, b. said lever arm passing through and being upwardly and downwardly movable within said slots, F. a thrust member pivotally attached to said lever arm, said thrust member being movable within said tube means, G. a crushing block, said block being attached to the lower extremity of said thrust member thereby compacting cans placed within said tube upon the lowering of said lever arm.

2. The can compactor of claim 1 wherein said tube means comprises a wall portion defining an opening opposite said slot whereby an instrument may be inserted to eject compacted cans through said slot.

3. The can compactor of claim 1 comprising a flat anvil member, said member comprising walls defining a slot fitting the bottom contour of said tube means and matching a portion of said groove whereby said tube means passes through said anvil member into said groove.

4. The can compactor of claim 1 comprising a sleeve member closely fitting over said tube means and covering said can-receiving opening during compacting.

5. The can compactor of claim 3 comprising a sleeve member closely fitting over said tube means, said sleeve member covering said can-receiving opening during compacting.

6. A can compactor comprising:

A. a base comprising walls defining a substantially horizontal groove in said base, B. an upwardly extending tube means fitting into said groove, C. a fulcrum post fixedly supported on said base, D. fulcrum means supported on said post, E. a lever arm pivotally supported by said fulcrum means, F. a structural loop projecting from said arm, G. a thrust member substantially uprightly positioned within said tube means and slidably engaged by said loop so as to retain a substantially upright position upon movement of said lever arm, H. crushing means attached to the lower extremity of said thrust member.

* * * * *